US010487656B2

(12) United States Patent
Lin et al.

(10) Patent No.: US 10,487,656 B2
(45) Date of Patent: Nov. 26, 2019

(54) METHOD FOR CONSTRUCTING NETWORKED PREFERENTIAL GAS MIGRATION PATHWAYS AND DIVERTING AND EXTRACTING GAS

(71) Applicant: China University of Mining and Technology, Jiangsu (CN)

(72) Inventors: Baiquan Lin, Jiangsu (CN); Tong Liu, Jiangsu (CN); Ting Liu, Jiangsu (CN); Wei Yang, Jiangsu (CN); He Li, Jiangsu (CN); Rui Wang, Jiangsu (CN); Zheng Wang, Jiangsu (CN)

(73) Assignee: China University of Mining and Technology, Jiangsu (CN)

( * ) Notice: Subject to any disclaimer, the term of this patent is extended or adjusted under 35 U.S.C. 154(b) by 0 days.

(21) Appl. No.: 16/098,131

(22) PCT Filed: Dec. 1, 2017

(86) PCT No.: PCT/CN2017/114229

§ 371 (c)(1),
(2) Date: Nov. 1, 2018

(87) PCT Pub. No.: WO2018/171255

PCT Pub. Date: Sep. 27, 2018

(65) Prior Publication Data

US 2019/0145260 A1 May 16, 2019

(30) Foreign Application Priority Data

Mar. 20, 2017 (CN) ..... 2017 1 0166050

(51) Int. Cl.

| | |
|---|---|
| ***E21F 7/00*** | (2006.01) |
| *E21B 43/17* | (2006.01) |
| *E21B 43/263* | (2006.01) |

(52) U.S. Cl.
CPC ..... *E21F 7/00* (2013.01); *E21B 43/17* (2013.01); *E21B 43/263* (2013.01)

(58) Field of Classification Search
CPC ..... E21F 7/00; E21B 43/006; E21B 43/26; E21B 43/261; E21B 43/263; E21B 43/17
See application file for complete search history.

(56) References Cited

U.S. PATENT DOCUMENTS 3,650,564 A * 3/1972 Williamson ..... E21C 37/00 102/311
3,814,480 A * 6/1974 Dahl ..... E21F 7/00 166/308.1

(Continued)

FOREIGN PATENT DOCUMENTS

CN 1532374 9/2004
CN 104712358 6/2015

(Continued)

OTHER PUBLICATIONS

"International Search Report (Form PCT/ISA/210)", dated Mar. 2, 2018, with English translation thereof, pp. 1-4.

*Primary Examiner* — David J Bagnell
*Assistant Examiner* — Michael A Goodwin
(74) *Attorney, Agent, or Firm* — JCIPRNET

(57) ABSTRACT

A method for constructing networked preferential gas migration pathways and diverting and extracting gas. The method proposes that a fracture generation hole, a fracture guidance and development hole, a lateral rupture hole, and a fracture connection hole are respectively constructed in a roof in roadways on two sides of a working face in advance of an advance stress change area. Artificial guided fractures are actively constructed and formed inside the hard roof. Under a mining-induced stress effect, the artificial guided fractures and mining-induced fractures intersect with and are connected to each other to form networked preferential gas (Continued)

migration pathways. Meanwhile, boreholes for artificial guided fractures accelerate roof fracturing to form a rupture bed separation fracture area in a roof. Gas flows and migrates in a timely and efficient manner along networked fracture pathways and concentrates in the rupture bed separation fracture area in the roof.

6 Claims, 1 Drawing Sheet

(56) References Cited

U.S. PATENT DOCUMENTS

| | | | | |
|---|---|---|---|---|
| 4,265,570 | A * | 5/1981 | Choi | E21C 41/16 299/16 |
| 4,544,208 | A * | 10/1985 | Miller | E21F 7/00 166/276 |
| 4,978,172 | A * | 12/1990 | Schwoebel | E21B 43/305 166/369 |
| 2009/0315388 | A1* | 12/2009 | Refsdal | E21B 43/006 299/5 |
| 2014/0117739 | A1* | 5/2014 | Gray | E21B 43/26 299/10 |
| 2017/0044887 | A1* | 2/2017 | Coetzee | E21F 7/00 |

FOREIGN PATENT DOCUMENTS

| | | | | |
|---|---|---|---|---|
| CN | 104863561 | | 8/2015 | |
| CN | 106014473 | | 10/2016 | |
| CN | 106948859 | | 7/2017 | |
| RU | 2108464 | | 4/1998 | |
| WO | WO-2015103861 | A1 * | 7/2015 | E21F 7/00 |

* cited by examiner

METHOD FOR CONSTRUCTING NETWORKED PREFERENTIAL GAS MIGRATION PATHWAYS AND DIVERTING AND EXTRACTING GAS

CROSS-REFERENCE TO RELATED APPLICATION

This is a 371 application of the International PCT application serial no. PCT/CN2017/114229, filed on Dec. 1, 2017, which claims the priority benefits of China Application No. 201710166050.0, filed on Mar. 20, 2017. The entirety of each of the above-mentioned patent applications is hereby incorporated by reference herein and made a part of this specification.

BACKGROUND OF THE INVENTION

Technical Field

The present invention relates to a method for constructing networked preferential gas migration pathways and diverting and extracting gas, which is particularly applicable to active construction of networked fracture pathways inside a roof and gas diversion and control under a condition that a hard roof covers a coal seam.

Background

China has complex occurrence conditions of underground coal seams. Occurrence conditions at the roof and floor of a coal seam affect the distribution of stopping stress and the evolution of fractures in a coal-rock stratum, and therefore affect the migration rule and flowing directions of mining gas. When a condition of a covering thick-layer hard roof exists, because the roof is hard and compact, the generation and evolution of fractures are difficult. Under only a mining-induced stress effect, it is difficult to rapidly form fracture pathways in the roof. In addition, a hard roof has relatively large strength and does not fracture easily, and therefore a large-area hanging roof is easily formed in a goaf. It is difficult for fracture pathways and bed separation space to be rapidly constructed and formed inside the hard roof by using a mining-induced effect, and gas cannot migrate and concentrate easily along the fracture pathways in the roof. A large amount of gas accumulates in the goaf, resulting in gas overrun. Moreover, the large-area hanging roof collapses suddenly to push the gas that accumulates in the goaf to be poured into a working face. As a result, the production safety at the working face is severely threatened, and gas control is difficult. How to construct gas migration pathways inside a roof above a coal seam in a covering thick-layer hard roof condition to implement efficient diversion and control of gas becomes a problem that urgently needs to be resolved in safe and efficient mining of coal seams.

SUMMARY OF THE INVENTION

Technical Problem

The objective of the present invention is to overcome the deficiencies in the prior art and provide a method for constructing networked preferential gas migration pathways and diverting and extracting gas that is simple, active, scientific, and efficient and can effectively resolve problems such as difficulty in generating fractures inside a thick layer hard roof, accumulation of gas in a goaf, difficulty in flowing and concentration of gas along preferential migration pathways, and difficulty in gas diversion.

To achieve the foregoing objective, a method for constructing networked preferential gas migration pathways and diverting and extracting gas of the present invention constructs artificial guided fractures around a fracture generation hole, a fracture guidance and development hole, a lateral rupture hole, and a fracture connection hole by using a deep-hole pre-splitting blasting process and includes the following steps.

a. According to occurrences of a coal seam and a roof, determining a stress distribution characteristic curve of a working face, and determining a length L of an advance stress change area.

b. At opposite locations in a primary intake airway and a retained-entry side intake airway respectively that are at a distance of the length L of the advance stress change area in advance of the working face, constructing respectively a fracture generation hole into a hard roof above the coal seam in a direction of facing the working face, performing a deep-hole pre-splitting blasting in the fracture generation hole so that a large quantity of fractures are blasting-induced and formed around the fracture generation hole inside the hard roof, weakening the connection between the hard roof and a hard-roof overlying stratum, and inducing and accelerating generation of bed separation fractures.

c. At the location where the fracture generation hole is constructed, constructing a fracture guidance and development hole into the hard roof above the coal seam in a direction of facing the working face, performing a deep-hole pre-splitting blasting in the fracture guidance and development hole, thereby a large quantity of fractures are formed around the fracture guidance and development hole and are connected to the fractures formed around the fracture generation hole, so as to guide evolution and development of fractures.

d. At the location where the fracture generation hole is constructed, constructing a lateral rupture hole into the hard roof above the coal seam in a direction of facing the working face to weaken a lateral area of the hard roof and control a lateral rupture location of the hard roof.

e. At the location where the fracture generation hole is constructed, constructing a fracture connection hole into the hard roof above the coal seam in a direction opposite the working face, performing a deep-hole pre-splitting blasting in the fracture connection hole, so that the fracture connection hole is connected to the fractures formed around the fracture generation hole, the fracture guidance and development hole, and the lateral rupture hole, eventually forming a group of artificial guided fractures having specific directions and morphological characteristics at the location inside the hard roof that is at the distance of the length L of the advance stress change area.

f. Performing stoping on the working face in a conventional manner, wherein during the stoping, mining-induced stress increases to reach a stress peak point, the mining-induced stress induces generation of fractures in the coal seam and the hard roof, gas inside the coal seam begins to be desorbed and diffused, and a large quantity of new fractures are generated around the group of artificial guided fractures formed inside the hard roof and are connected to fractures formed in mining.

g. Each time the working face advances by ½ of the length L of the advance stress change area, repeating steps b to e, in which a group of holes for artificial guided fractures are constructed.

h. As the working face advances, the mining-induced stress beginning to drop from the stress peak point, where the reduction of confining pressure leads to development of a large quantity of fractures in the hard roof, the fracture connection hole begins to produce an inter-group fracture connection effect, adjacent artificial guided fractures begin to be connected to each other, networked preferential gas migration pathways are formed inside the hard roof, at the same time the development of fractures inside the hard roof reduces the rigidity and bearing performance of the hard roof, the hard roof begins to sink, the bed separation fractures begin to be formed, and gas desorbed from coal mass begins to migrate and flow upward along the networked preferential gas migration pathways and gathers in the bed separation fractures.

i. As the working face keeps advancing, the fractures inside the hard roof further developing behind the working face, wherein the networked preferential gas migration pathways develop into full form step by step, at the same time the bed separation fractures in the roof further develop, and gas gradually concentrates inside the bed separation fractures in the roof along the networked preferential gas migration pathways.

The formation of the networked preferential gas migration pathways inside the hard roof reduces the overall strength and rigidity of the hard roof, the caving and rupturing time and distance of the hard roof are reduced, rupturing occurs behind the working face, a rupture bed separation fracture area is formed above a goaf, and the gas in the goaf migrates upward and concentrates in the rupture bed separation fracture area.

j. Determining, according to orientations of the constructed fracture generation hole and fracture guidance and development hole and occurrence characteristics of the roof, a location of the rupture bed separation fracture area in the roof above the goaf and orientations of gas diversion and extraction boreholes in a retained entry.

k. Constructing the gas diversion and extraction boreholes in the rupture bed separation fracture area above the goaf in the retained entry behind the working face, and performing centralized diversion and extraction on the gas in the rupture bed separation fracture area.

A Hole bottom height of the fracture generation hole is at 2 m to 3 m above the hard roof.

A distance a between ends of two fracture guidance and development holes oppositely constructed in the primary intake airway and the retained-entry side intake airway does not exceed 20 m, and a distance b between ends of two fracture generation holes oppositely constructed in the primary intake airway and the retained-entry side intake airway does not exceed ⅓ of the length of the working face.

A plurality of gas diversion and extraction boreholes are constructed in the retained entry.

An elevation angle $\alpha$ of a gas diversion and extraction borehole constructed in the retained entry is greater than an elevation angle of the fracture generation hole.

Beneficial Effect

In the present invention, in view of the problems that it is difficult to form a gas migration pathway in a roof in a hard roof condition and it is difficult to implement preferential concentration and centralized extraction of gas, boreholes for artificial guided fractures are actively constructed in a hard roof at advance stress change area in advance of a working face, and networked artificial guided fractures are generated inside coal mass. By means of the change of mining-induced stress, networked preferential gas migration pathways are further formed. Gas flows upward along the networked preferential migration pathways in a roof, thereby resolving the problem that it is difficult to generate hard roof fractures and as a result high-concentration gas accumulates in a goaf for a long time. Meanwhile, the boreholes for artificial guided fractures induce formation of networked fractures inside a hard roof, so that the strength and rigidity of the hard roof are reduced, the roof fracturing period is shortened, the formation of a rupture bed separation fracture area in a goaf is accelerated, gas in the goaf concentrates in the rupture bed separation fracture area along the networked fracture pathways in the roof, and reference is provided for construction orientations of gas extraction boreholes in the roof, so as to create desirable conditions for centralized diversion and control of gas at a stope. Boreholes for artificial guided fractures are actively constructed in advance to actively construct and form networked preferential gas migration pathways inside a hard roof, so that roof fracturing is accelerated to enable gas to migrate and concentrate in a rupture bed separation fracture area in a roof in time along the preferential pathways, so as to facilitate centralized diversion and control of gas at a stope in a coal seam. A series of gas problems caused by hard roofs are effectively resolved, so that actively guided flowing of gas at a stope and scientific control are implemented. The method in the present invention is simple and has convenient operations, desirable effects, and wide practicability in the technical field.

Figure 1:
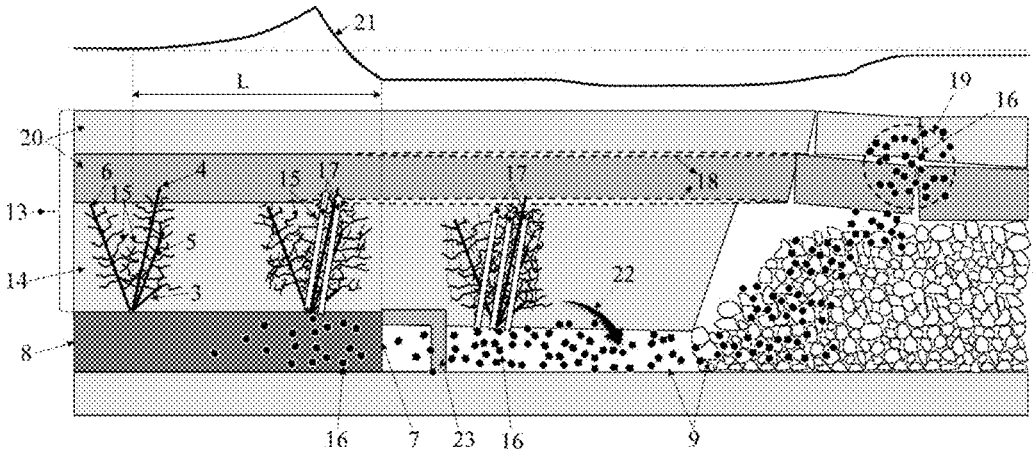
FIG. 1 is a schematic view of a method for constructing networked preferential gas migration pathways according to the present invention.

In the drawings: 1—retained—entry side intake airway, 2—primary intake airway, 3—lateral rupture hole, 4—fracture guidance and development hole, 5—fracture generation hole, 6—fracture connection hole, 7—working face, 8—coal seam, 9—goaf, 10—retained entry, 11—gas extraction borehole, 12—gas pipeline, 13—roof, 14—hard roof, 15—the artificial guided fracture, 16—gas, 17—preferential gas migration pathway, 18—bed separation fractures, 19—rupture bed separation fracture area, 20—hard—roof overlying stratum, 21—stress distribution characteristic curve, 22—hard roof fracture direction, 23—hydraulic support, and 24—filling wall.

DETAILED DESCRIPTION OF THE INVENTION

The present invention is further described below with reference to the embodiments in the accompanying drawings.

In a method for constructing networked preferential gas migration pathways and diverting and extracting gas of the present invention, artificial guided fractures around a fracture generation hole (4), a fracture guidance and development hole (5), a lateral rupture hole (3), and a fracture connection hole (6) are constructed by using a deep-hole pre-splitting blasting process. Specific steps are as follows.

a. According to occurrences of a coal seam 8 and a roof 13, determining a stress distribution characteristic curve 21 of a working face, and determining a length L of an advance stress change area.

b. At opposite locations in a primary intake airway 2 and a retained-entry side intake airway 1 respectively that are at a distance of the length L of the advance stress change area in advance of the working face 7, constructing respectively a fracture generation hole 4 into a hard roof 14 above the coal seam 8 in a direction of facing the working face 7, performing a deep-hole pre-splitting blasting in the fracture generation hole 4 so that a large quantity of fractures are blasting-induced and formed around the fracture generation hole 4 inside the hard roof 14, weakening the connection between the hard roof 14 and a hard-roof overlying stratum 20, and inducing and accelerating generation of bed separation fractures 18.

c. At the location where the fracture generation hole 4 is constructed, constructing a fracture guidance and development hole 5 into the hard roof 14 above the coal seam 8 in a direction of facing the working face 7, performing a deep-hole pre-splitting blasting in the fracture guidance and development hole 5, thereby a large quantity of fractures are formed around the fracture guidance and development hole 5 and are connected to the fractures formed around the fracture generation hole 4, so as to guide evolution and development of fractures.

d. At the location where the fracture generation hole 4 is constructed, constructing a lateral rupture hole 3 into the hard roof 14 above the coal seam 8 in a direction of facing the working face 7 to weaken a lateral area of the hard roof 14 and control a lateral rupture location of the hard roof 14.

e. At the location where the fracture generation hole 4 is constructed, constructing a fracture connection hole 6 into the hard roof 14 above the coal seam 8 in a direction opposite the working face 7, performing a deep-hole pre-splitting blasting in the fracture connection hole 6, so that the fracture connection hole 6 is connected to the fractures formed around the fracture generation hole 4, the fracture guidance and development hole 5, and the lateral rupture hole 3, eventually forming a group of artificial guided fractures 15 having specific directions and morphological characteristics at the location inside the hard roof 14 that is at the distance of the length L of the advance stress change area.

f. Performing stoping on the working face 7 in a conventional manner, wherein during the stoping, mining-induced stress increases to reach a stress peak point, the mining-induced stress induces generation of fractures in the coal seam 8 and the hard roof 14, gas 16 inside the coal seam 8 begins to be desorbed and diffused, and a large quantity of new fractures are generated around the group of artificial guided fractures 15 formed inside the hard roof 14 and are connected to fractures formed in mining.

g. Each time the working face advances by ½ of the length L of the advance stress change area, repeating steps b to e, in which a group of holes for artificial guided fractures are constructed.

h. As the working face advances, mining-induced stress beginning to drop from the stress peak point, where the reduction of confining pressure leads to development of a large quantity of fractures in the hard roof 14, the fracture connection hole 6 begins to produce an inter-group fracture connection effect, adjacent artificial guided fractures 15 begin to be connected to each other, networked preferential gas migration pathways 17 are formed inside the hard roof 14, at the same time the development of fractures inside the hard roof 14 reduces the rigidity and bearing performance of the hard roof 14, the hard roof 14 begins to sink, the bed separation fractures 18 begin to be formed, and gas 16 desorbed from coal mass 8 begins to migrate and flow upward along the networked preferential gas migration pathways 17 and gathers in the bed separation fractures 18.

i. As the working face 7 keeps advancing, behind the working face 7, the fractures inside the hard roof 14 further developing, where the networked preferential gas migration pathways 17 develop into full form step by step, at the same time the bed separation fractures 18 in the roof further develop, and gas 16 gradually concentrates inside the bed separation fractures 18 in the roof along the networked preferential gas migration pathways 17.

The formation of the networked preferential gas migration pathways 17 inside hard roof 14 reduces the overall strength and rigidity of the hard roof 14, the caving and rupturing time and distance of the hard roof 14 are reduced, rupturing occurs behind the working face 7, a rupture bed separation fracture area 19 is formed above a goaf 9, and the gas 16 in the goaf 9 migrates upward and concentrates in the rupture bed separation fracture area 19.

j. Determining, according to orientations of the constructed fracture generation hole 4 and the fracture guidance and development hole 5 and occurrence characteristics of the roof 13, a location of the rupture bed separation fracture area 19 in the roof above the goaf 9 and orientations of gas diversion and extraction boreholes 11 in a retained entry 10, where a plurality of gas diversion and extraction boreholes 11 are constructed in the retained entry 10, and an elevation angle $\alpha$ of a gas diversion and extraction borehole 11 constructed in the retained entry 10 is greater than an elevation angle of the fracture generation hole 4.

k. Constructing the gas diversion and extraction boreholes 11 in the rupture bed separation fracture area 19 above the goaf 9 in the retained entry 10 behind the working face 7, and performing centralized diversion and extraction on the gas 16 in the rupture bed separation fracture area 19.

Figure 2:
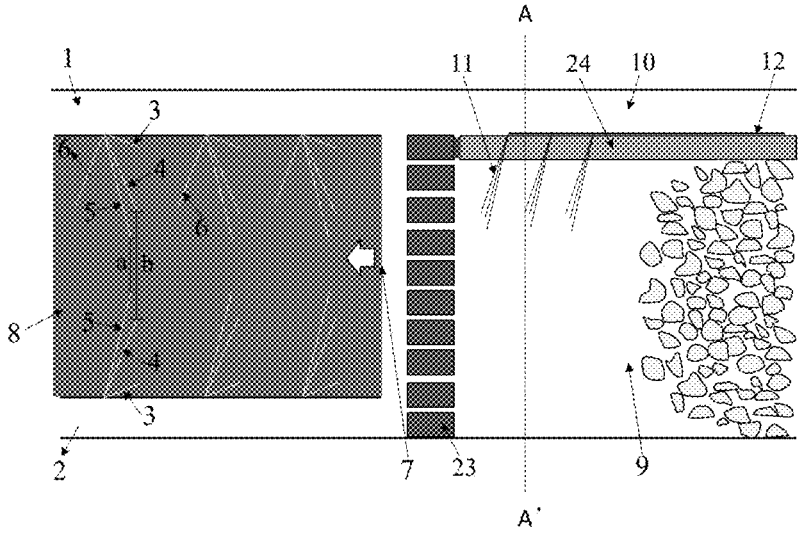
FIG. 2 is a schematic view of plan arrangement of boreholes for artificial guided fractures and gas diversion and extraction boreholes according to the present invention.
Figure 3:
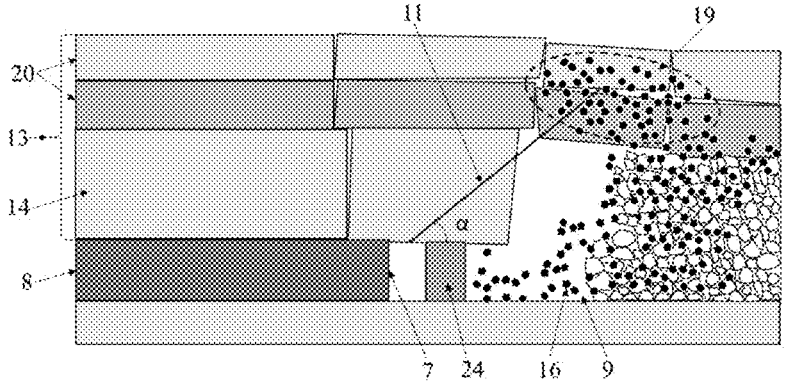
FIG. 3 is a schematic sectional view of arrangement of gas diversion and extraction boreholes in a direction A-A' at a location of a goaf according to the present invention.

Embodiment 1, a thick-layer hard roof 14 covers a roof in a coal seam, the thickness of the hard roof is 17 m, and the length of a working face is 150 m. A method for constructing networked preferential gas migration pathways and diverting and extracting gas is as follows:

As shown in FIG. 1, first, a stress distribution characteristic in advance of the working face is analyzed according to occurrences of the coal seam 8 and the roof 13. The presence of the hard roof increases the length of the advance stress change area. It is determined from the stress distribution characteristic curve 21 in advance of the working face that the length of the advance stress change area is 50 m, that is, an advance construction distance of boreholes for artificial guided fractures. As shown in FIG. 2, at a location that is 50 m in advance of the working face in the primary intake airway 2 and the retained-entry side intake airway 1 of the working face 7, in the direction facing the working face 7, the fracture generation hole 4 is constructed into the hard roof 14 above the coal seam 8. The height of the end of the fracture generation hole 4 is at 2 m to 3 m above the hard roof 14. It is determined that the height of the end is 20 m. Deep-hole pre-splitting blasting is performed in the fracture generation hole 4. Blasting is carried out inside the hard roof 14 to induce formation of fractures having a particular direction. At the same time, the connection between the hard roof 14 and the hard-roof overlying stratum 20 is weakened, and the generation of bed separation fractures 18 is induced and accelerated. The fracture guidance and development hole 5 is constructed into the hard roof 14 above the coal seam 8 facing the working face 7, where after deep-hole pre-splitting blasting is performed in the fracture guidance and development hole 5, fractures are formed around the fracture guidance and development hole 5 and are connected to the fractures formed by the fracture generation hole 4, so as to guide evolution and development of fractures. To ensure the processing effect and range of the boreholes for artificial guided fractures on the hard roof 14, it is determined that a distance between ends of the fracture guidance and development holes 5 in the primary intake airway 2 and the retained-entry side intake airway 1 of the working face 7 is 20 m. A distance between ends of the fracture generation holes 4 does not exceed ⅓ of the length of the working face, and the distance is 50 m. The lateral rupture hole 3 is constructed into the hard roof 14 above the coal seam 8 facing the working face 7 to weaken a lateral area of the hard roof 14 and control a lateral fracture location of the hard roof 14. The fracture connection hole 6 is constructed into the hard roof 14 above the coal seam 8 opposite the working face 7. Deep-hole pre-splitting blasting is performed in the fracture connection hole 6. The fracture connection hole 6 is connected to the fractures formed by the fracture generation hole 4, the fracture guidance and development hole 5, and the lateral rupture hole 3. Eventually, the artificial guided fractures 15 having specific directions and morphological characteristics are formed in a location that is 50 m in advance of the working face inside the hard roof 14. As the working face 7 advances, mining-induced stress first increases to reach a stress peak point. In this process, the mining-induced stress induces generation of fractures in the coal seam 8 and the hard roof 14. Gas 16 inside the coal seam 8 begins to be desorbed and diffused, and a large quantity of new fractures are generated around the artificial guided fractures 15 formed inside the hard roof 14 and are connected to the fractures formed in mining for development. Mining-induced stress reaches a stress peak point and then drops. The reduction of confining pressure leads to development of a large quantity of fractures in the hard roof 14, the fracture connection hole 6 begins to produce an inter-group fracture connection effect, adjacent artificial guided fractures 15 begin to be connected to each other, networked preferential gas migration pathways 17 are formed inside hard roof 14, at the same time the development of fractures inside the hard roof 14 reduces the rigidity and bearing performance of the hard roof 14, the hard roof 14 begins to sink, the bed separation fractures 18 begin to be formed, and gas 16 desorbed from coal mass 8 begins to migrate and flow upward along the networked preferential gas migration pathways 17 and gathers in the bed separation fractures 18. As the working face 7 keeps advancing, behind the working face 7, the fractures inside the hard roof 14 further develop, where the networked preferential gas migration pathways 17 develop into full from step by step, at the same time the bed separation fractures 18 in the roof further develop, and gas 16 gradually concentrates inside the bed separation fractures 18 in the roof along the networked preferential gas migration pathways 17. The formation of the networked preferential gas migration pathways 17 inside the hard roof 14 reduces the overall strength and rigidity of the hard roof 14, the caving and rupturing time and distance of the hard roof 14 are reduced, rupturing occur at a particular distance behind the working face 7, a rupture bed separation fracture area 19 is formed above a goaf 9, and the gas 16 in the goaf 9 migrates upward and concentrates in the rupture bed separation fracture area 19. A location of the rupture bed separation fracture area 19 in the roof above the goaf 9 and orientations of the gas diversion borehole 11 in the retained entry 10 are determined according to orientations of the constructed boreholes for artificial guided fractures and occurrence characteristics of the roof 13. It is required that an elevation angle $\alpha$ of a gas diversion and extraction borehole 11 constructed in the retained entry 10 is greater than an elevation angle of the fracture generation hole 4. It is calculated according to the height and width of the fracture generation hole 4 that the elevation angle of the fracture generation hole 4 is 22°. It is determined according to a stratum fracturing characteristic that the elevation angle $\alpha$ of the gas diversion and extraction boreholes 11 is 25° to 30°. As shown in FIG. 3, the gas diversion and extraction boreholes 11 is constructed in the rupture bed separation fracture area 19 above the goaf 9 in the retained entry 10 behind the working face 7, and centralized diversion and extraction control is performed on the gas 16 in the rupture bed separation fracture area 19.

What is claimed is:

1. A method for constructing networked preferential gas migration pathways and diverting and extracting gas, comprising constructing artificial guided fractures around a fracture generation hole, a fracture guidance and development hole, a lateral rupture hole, and a fracture connection hole by using a deep-hole pre-splitting blasting process, comprising:

a. determining a stress distribution characteristic curve of a working face according to distributions of a coal seam and a roof, and determining a length (L) of an advance stress change area;

b. at opposite locations in a primary intake airway and a retained-entry side intake airway respectively that are at a distance of the length (L) of the advance stress change area in advance of the working face, constructing respectively a fracture generation hole into a hard roof above the coal seam in a direction of facing the working face, performing a blasting in the fracture generation hole so that a large quantity of fractures are blasting-induced and formed around the fracture generation hole inside the hard roof, weakening the connection between the hard roof and a hard-roof overlying stratum, and inducing and accelerating generation of bed separation fractures;

c. at the locations where the fracture generation holes are constructed, constructing a fracture guidance and development hole into the hard roof above the coal seam in a direction of facing the working face, performing the blasting in the fracture guidance and development hole, thereby a large quantity of fractures are formed around the fracture guidance and development hole and are connected to the fractures formed around the fracture generation hole, so as to guide evolution and development of fractures;

d. at the locations where the fracture generation holes are constructed, constructing a lateral rupture hole into the hard roof above the coal seam in a direction of facing the working face to weaken a lateral area of the hard roof and control a lateral rupture location of the hard roof;

e. at the locations where the fracture generation holes are constructed, constructing a fracture connection hole into the hard roof above the coal seam in a direction opposite the working face, performing the blasting in the fracture connection hole, so that the fracture connection hole is connected to the fractures formed around the fracture generation hole, the fracture guidance and development hole, and the lateral rupture hole, which forms a group of artificial guided fractures at a location inside the hard roof that is at the distance (L) of the advance stress change area in advance of the working face;

f. performing stoping on the working face in a conventional manner, wherein during the stoping, mining-induced stress increases to reach a stress peak point, the mining-induced stress induces generation of fractures in the coal seam and the hard roof, gas inside the coal seam begins to be desorbed and diffused, and a large quantity of new fractures are generated around the group of artificial guided fractures formed inside the hard roof and are connected to fractures formed in mining;

g. each time the working face advances by ½ of the length (L) of the advance stress change area, repeating steps b to e, in which a group of holes for artificial guided fractures are constructed;

h. as the working face advances, the mining-induced stress begins to drop from the stress peak point, wherein the reduction of confining pressure leads to development of a large quantity of fractures in the hard roof, the fracture connection hole begins to produce an inter-group fracture connection effect, adjacent artificial guided fractures begin to be connected to each other, thereby networked preferential gas migration pathways are formed inside the hard roof, at the same time the development of fractures inside the hard roof reduces a rigidity and bearing performance of the hard roof, the hard roof begins to sink, the bed separation fractures begin to be formed, and gas desorbed from a coal mass begins to migrate and flow upward along the networked preferential gas migration pathways and gathers in the bed separation fractures;

i. as the working face keeps advancing, the fractures inside the hard roof further develop behind the working face, wherein the networked preferential gas migration pathways develop gradually, at the same time the bed separation fractures in the roof further develop, and gas gradually concentrates inside the bed separation fractures in the roof along the networked preferential gas migration pathways;

the formation of the networked preferential gas migration pathways inside the hard roof reduces an overall strength and rigidity of the hard roof, a caving and rupturing time and distance of the hard roof are reduced, rupturing occurs behind the working face, a rupture bed separation fracture area is formed above a goaf, and gas in the goaf migrates upward and concentrates in the rupture bed separation fracture area;

j. determining, according to orientations of the constructed fracture generation hole and the fracture guidance and development hole and the distribution of the roof, a location of the rupture bed separation fracture area in the roof above the goaf and orientations of gas diversion and extraction boreholes in a retained entry;

k. constructing the gas diversion and extraction boreholes into the rupture bed separation fracture area above the goaf in the retained entry behind the working face, and performing centralized diversion and extraction on the gas in the rupture bed separation fracture area.

2. The method for constructing networked preferential gas migration pathways and diverting and extracting gas according to claim 1, wherein an end of the fracture generation hole is at 2 m to 3 m above the hard roof.

3. The method for constructing networked preferential gas migration pathways and diverting and extracting gas according to claim 1, wherein a distance (a) between ends of two fracture guidance and development holes oppositely constructed in the primary intake airway and the retained-entry side intake airway does not exceed 20 m, and a distance (b) between ends of two fracture generation holes oppositely constructed in the primary intake airway and the retained-entry side intake airway does not exceed ⅓ of a length of the working face.

4. The method for constructing networked preferential gas migration pathways and diverting and extracting gas according to claim 1, wherein a plurality of gas diversion and extraction boreholes are constructed in the retained entry.

5. The method for constructing networked preferential gas migration pathways and diverting and extracting gas according to claim 4, wherein an elevation angle ($\alpha$) of a gas diversion and extraction borehole constructed in the retained entry is greater than an elevation angle of the fracture generation hole.

6. The method for constructing networked preferential gas migration pathways and diverting and extracting gas according to claim 1, wherein an elevation angle ($\alpha$) of a gas diversion and extraction borehole constructed in the retained entry is greater than an elevation angle of the fracture generation hole.

* * * * *